US005352018A

United States Patent [19]

Arakawa et al.

[11] Patent Number: 5,352,018

[45] Date of Patent: Oct. 4, 1994

[54] LUMBAR SUPPORT FOR SEAT

[75] Inventors: Shinji Arakawa; Harufumi Terasawa; Masahiro Tachibana; Isamu Chinomi, all of Ayase, Japan

[73] Assignee: Ikeda Bussan Co., Ltd., Ayase, Japan

[21] Appl. No.: 73,562

[22] Filed: Jun. 9, 1993

[30] Foreign Application Priority Data

Jun. 9, 1992 [JP] Japan ..... 4-174770
Jun. 9, 1992 [JP] Japan ..... 4-174771

[51] Int. Cl.[5] ..... A47C 3/00
[52] U.S. Cl. ..... 297/284.4; 297/284.1
[58] Field of Search ..... 297/284.1, 284.4, 284.8, 297/284.2

[56] References Cited

U.S. PATENT DOCUMENTS 4,564,235 1/1986 Hatsutta et al. ..... 297/284.4
4,725,095 2/1988 Benson et al. ..... 297/284.1
4,886,316 12/1989 Suzuyama et al. ..... 297/284.4

FOREIGN PATENT DOCUMENTS 4038345 3/1992 Fed. Rep. of Germany .
63-17654 2/1988 Japan .

*Primary Examiner*—Kenneth J. Dorner
*Assistant Examiner*—Milton Nelson, Jr.
*Attorney, Agent, or Firm*—Foley & Lardner

[57] ABSTRACT

A support shaft has an integral protrusion which is abuttingly engageable with an arcuate portion of a support panel for limiting rotation of the support panel relative to the support shaft. A protrusion is provided at each axial end of the support shaft, while an opening with a slit-like opening portion is provided on each side panel of a seat back frame. The protrusion at each axial end of the support shaft and the opening at each side panel are constructed and arranged so that each axial end is capable of passing through the opening only when the support shaft is held in a particular position. The support shaft is put out of the particular position when in use such that each axial end is prevented from slipping out of the opening.

8 Claims, 3 Drawing Sheets

LUMBAR SUPPORT FOR SEAT

BACKGROUND OF THE INVENTION

1. Field of the Invention

The present invention relates in general to a lumbar support for a seat and more particularly to a lumbar support of the kind consisting of a support shaft rotatably installed at its opposite ends on a seat back frame and a support panel installed on a cranked portion of the support shaft for forward and rearward movement therewith.

2. Description of the Prior Art

It has heretofore been desirable for an automobile or the like to have a seat which is capable of stably supporting a seated occupant while providing seating comfort and minimizing fatigue of the seated occupant.

To this end, a seat is provided with various additional support mechanisms. One of such known support mechanisms is a lumbar support provided to a seat back frame to support thereon the lumbar section of a seated occupant.

An example of a prior art lumbar support is disclosed in Japanese Utility Model Provisional Publication No. 63-17654.

A problem of the prior art lumbar support is the need for a stopper member that is welded or otherwise secured to a support shaft for limiting movement of a support panel relative to the shaft, thus increasing the number of constituent parts and the manufacturing and assembling expense.

Another problem is that the support shaft needs to have at opposite ends thereof stepped shaft portions which requires costly machining to produce. A pair of bushing nuts is needed for attachment to the stepped shaft portions for limiting movement of the shaft in the axial direction thereof, thus further increasing the number of constituent parts and the manufacturing and assembling expense.

SUMMARY OF THE INVENTION

According to an aspect of the present invention, there is provided an improved lumbar support for a seat which comprises a support shaft rotatably installed at its opposite ends on a seat back frame of the seat and having a cranked portion, a support panel, retainer means for rotatably holding the support panel on the support shaft, and means for limiting rotation of the support panel relative to the support shaft.

The support shaft has at the cranked portion an integral protrusion which protrudes radially outward in opposite directions and is abuttingly engageable at opposite ends thereof with the support panel for preventing farther rotation of the support panel relative to the support shaft. The protrusion of the support shaft constitutes part of the limiting means.

According to another aspect of the present invention, there is provided an improved lumbar support assembly in a seat. The lumbar support assembly comprises a seat back frame having a pair of laterally opposed side panels, a support shaft rotatably installed at its opposite ends on the side panels of the seat back frame and having a cranked portion, and a support panel limitedly rotatably installed on the cranked portion.

The side panels have openings in which the opposite ends of the support shaft are installed. The support shaft has at each end a protrusion protruding radially outward of the support shaft. Each of the openings has a circular opening portion and a slit-like opening portion protruding radially outward from a circumference of the circular opening portion. The slit-like opening portion is sized so as to allow only the protrusion of the support shaft to pass therethrough. Each end of the support shaft with the protrusion is capable of passing through the opening only when the support shaft is held in a particular position where the cranked portion is located in a nearly horizontal plane. The support shaft is normally held out of the particular position after each end thereof is passed through the opening to place the protrusion on an outer side of each side panel.

The above structures are effective for solving the above noted problem inherent in the prior art device.

It is accordingly an object of the present invention to provide an improved lumbar support for a seat such as an automotive seat which can reduce the number of constituent parts and therefore the manufacturing and assembling expense.

DETAILED DESCRIPTION OF THE PREFERRED EMBODIMENTS

Figure 1:
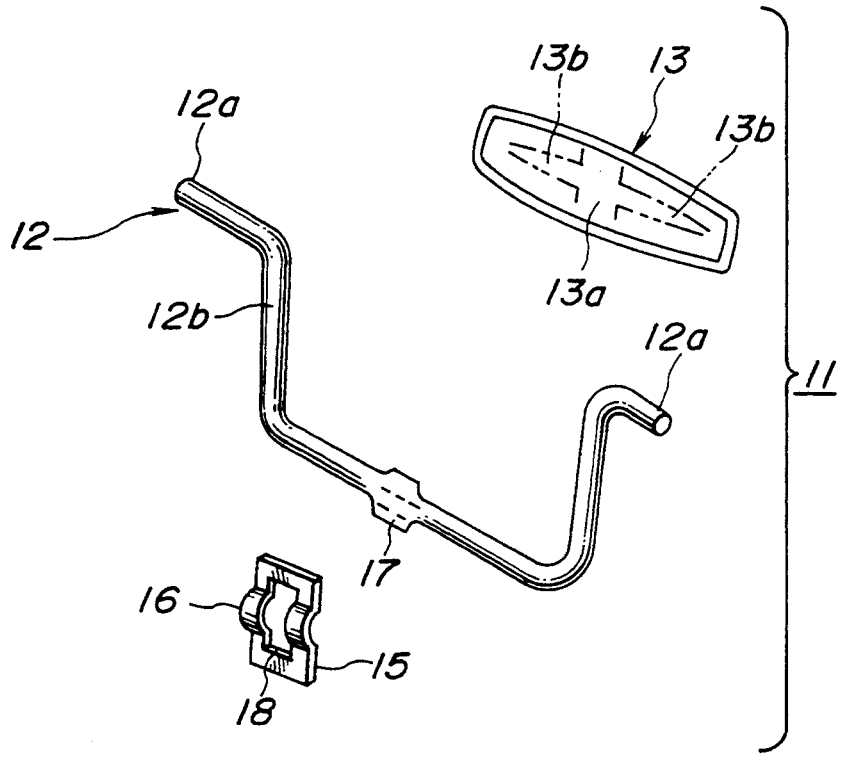
FIG. 1 is an exploded view of a principal portion of a lumbar support according to an embodiment of the present invention.
Figure 2:
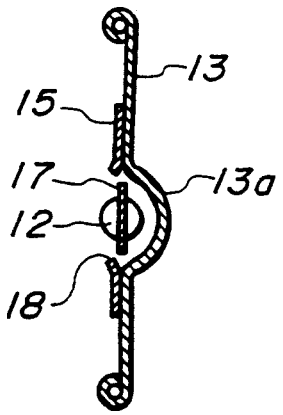
FIG. 2 is a cross sectional view of the principal portion of the lumbar support of FIG. 1.
Figure 3:
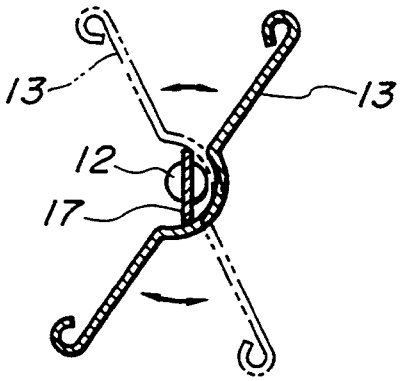
FIG. 3 is a view for illustrating limited movement of a support panel of the embodiment of FIG. 1 relative to support shaft thereof.

Referring first to FIGS. 1 to 3, a lumbar support is generally indicated by 11 and shown as including a support shaft 12 rotatably installed at its opposite ends 12*a* on a seat back frame (refer to FIG. 4) and having a cranked portion 12*b* between the opposite ends 12*a*, and a support panel 13 installed on an outer end of the cranked portion 12*b* by means of a retainer 15.

The support shaft 12 is connected to a conventional drive mechanism (not shown) using an eccentric cam, spring, etc. so that the cranked portion 12*b* is movable forward and rearward together with the support plate 13 for adjusting the amount of protrusion of a lower section of a seat back (not shown). In this connection, the support panel 13 is limitedly rotatable relative to the support shaft 12 as will be described in detail hereinbelow so that it is always brought into surface-to-surface contact with the lower section of the seat back. The support panel 13 is formed with a first vertically arcuate portion 13*a* and a pair of second vertically arcuate portions 13*b* on horizontally opposite sides of the first vertically arcuate portion 13*a* for reinforcement and its improved engagement with the support shaft 12.

The support shaft 12 is formed from a rod or pipe of circular cross section and has at a place where the support panel 13 is installed an integral protrusion 17 which is abuttingly engageable at opposite ends thereof with the first vertically arcuate portion 13*a* for preventing further rotation of the support panel 13 relative to the support shaft 12. The protrusion 17 of the support shaft 12 is formed by a metal stamping process using a die.

The protrusion 17 of the support shaft 12 is so shaped as to cross the axis of the cranked portion 12*b* at right angles, i.e., to protrude radially outward from the outer end of the cranked portion 12*b* in opposite directions or protrude upward and downward from the outer end of the cranked portion 12*b*.

The retainer 15 has a pair of vertically arcuate portions 16 which cooperates with the pair of second vertically arcuate portions 13*b* of the support panel 13 to rotatably hold therebetween the support shaft 12. The retainer 15 further has at a location between the vertically arcuate portions 16 an opening 18 for allowing the protrusion 17 of the support shaft 12 to protrude outward therethrough.

In assembly of the lumbar support 11, the retainer 15 is spot-welded or otherwise secured to the support panel 13 with the protrusion 17 of the support shaft 12 being positioned in the opening 18 of the retainer 15 and associated with the first vertically arcuate portion 13*a* of the support panel 13 whilst rotatably holding the support shaft 12 between the vertically arcuate portions 16 of the retainer 15 and the second vertically arcuate portions 13*b* of the support panel 13.

With the above structure, turning or rotation of the support panel 13 relative to the support shaft 12 is limited to a predetermined range, i.e., turning or rotation of the support panel 13 relative to the support shaft 12 is limited by engagement of the upper and lower ends of the protrusion 17 with the first vertically arcuate portion 13*a* of the support panel 13, as shown in FIG. 3 . Further, axial movement of the support shaft 12 relative to the support panel 13 is limited by the engagement of the protrusion 17 with the opposite edges of the retainer 15 defining the opening 18.

The rotatable range of the support panel 13 can be variably set depending upon variations of the protruded amount of the protrusion 17 and/or the shape of the arcuate portion 13*a* of the support panel 13.

In the mean time, the support shaft 12 may be formed with a plurality of such protrusions 17 and a corresponding number of such retainers 15 may be employed.

Figure 4:
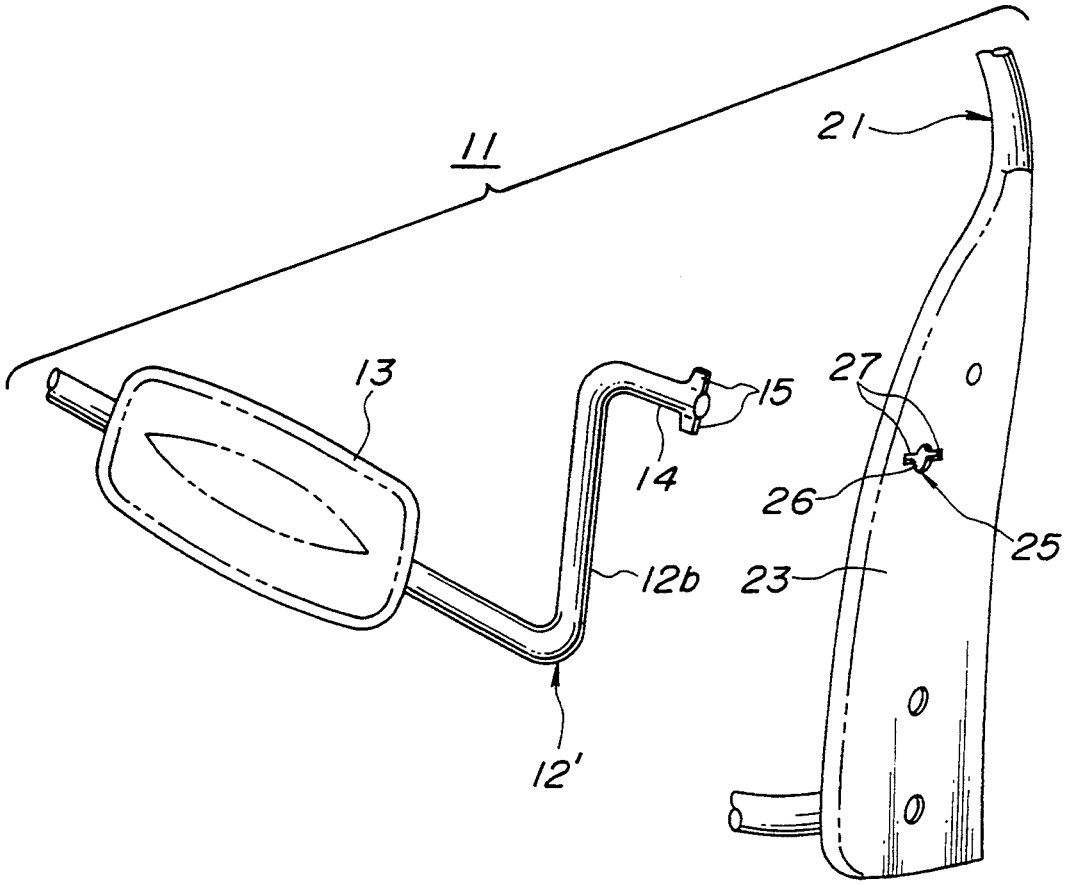
FIG. 4 is a view similar to FIG. 1 but showing another embodiment of the present invention.
Figure 5:
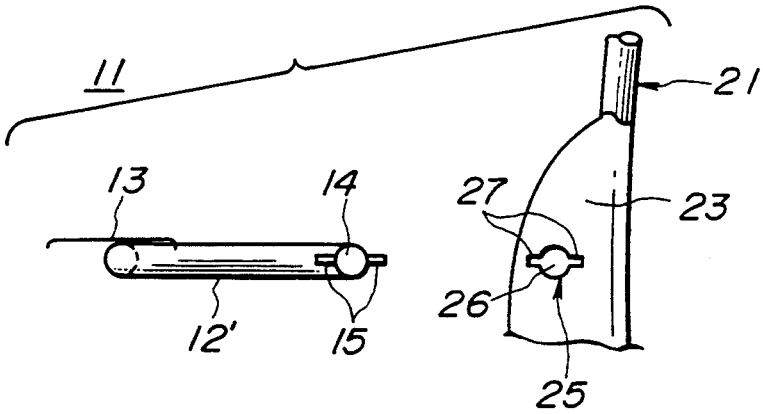
FIG. 5 is a side elevational view of the lumbar support of FIG. 4 in its position for installation to a seat back frame.

FIGS. 4 and 5 show another embodiment of the present invention in which the support shaft 12' has at each axial end a protrusion 15 protruding in such a way as to cross the axis of each axial end portion of the support shaft 12' at right angles to serve as a stopper, i.e., like the protrusion 17 which protrudes radially outward in opposite directions.

In this embodiment, the protrusion 15 is so shaped as to be located together with the cranked portion 12*a* in a common plane. However, this is not for the purpose of limitation as they may have various shapes and thicknesses as required. The protrusion 15 is formed by a metal stamping process using a die or otherwise may be formed by welding an independent member to each axial end of the support shaft 12'.

The support shaft 12' is rotatably installed at its opposite ends 14 on a seat back frame 21. The seat back frame 21 is formed at each side panel 23 with an opening 25 which permits the corresponding end 14 of the support shaft 12' having the protrusion 15 to pass therethrough. The opening 25 consists of a circular opening portion 26 sized to be a little larger in diameter than the circular cross sectional portion of the support shaft 12' so as to make the circular cross sectional portion of the shaft 12' capable of passing therethrough and a slit-like opening portion 27 horizontally elongated and protruding radially outward from the circumference of the circular opening portion 26 in opposite directions. The slit-like opening portion 27 is sized to be a little larger than the protrusion 15 so as to enable only the protrusion 15 to pass therethrough when the support shaft 12' is placed in a particular position, e.g., in a position where the cranked portion 12*b* is located in a nearly horizontal plane.

In assembly of the lumbar support 11, the support shaft 12' is first held as shown in FIG. 5, i.e., in a position where the cranked portion 12*b* is located in a nearly horizontal plane to make the protrusion 15 coincide in the protruding direction with the slit-like opening portion 27 of the opening 25. The protrusion 15 at one end 14 of the support shaft 12' is then aligned with the slit-like opening portion 27 of the opening 25. One end 14 of the support shaft 12' is inserted into the opening 25 to protrude outward therethrough. In this connection, the support shaft 12 is inclined a little in the longitudinal direction, i.e., in the lateral direction of the seat back frame 21, so as to enable insertion of one end 14 of the support shaft 12' into the opening 25. The other end 14 of the support shaft 12' is then inserted into the corresponding opening 25, with the already inserted end 14 being made to protrude outward of the corresponding side panel 23. Thereafter, the support shaft 12' is rotated into a position where the cranked portion 12*a* is located in a nearly vertical plane. Consequently, when the support shaft 12' is axially urged in one direction, one of the protrusions 15 is abuttingly engaged with the side panel 23, thereby preventing further axial movement of the support shaft 12', i.e., one of the protrusions 15 prevents the corresponding end 14 from passing through the opening 25 and slipping off therefrom. The protrusions 15 are thus held on the outer sides of the side panels 23 to prevent the opposite axial ends 14 from slipping out of the openings 25, respectively.

The protrusions 15 at the opposite ends 14 of the support shaft 12' are thus engageable with the side panels 23 so as to be held on the outer sides thereof whilst restricting lateral or axial movement of the support shaft 12' relative to the seat back frame 21, thus making it possible to assuredly hold the support shaft 12' on the seat back frame 21.

Figure 6:
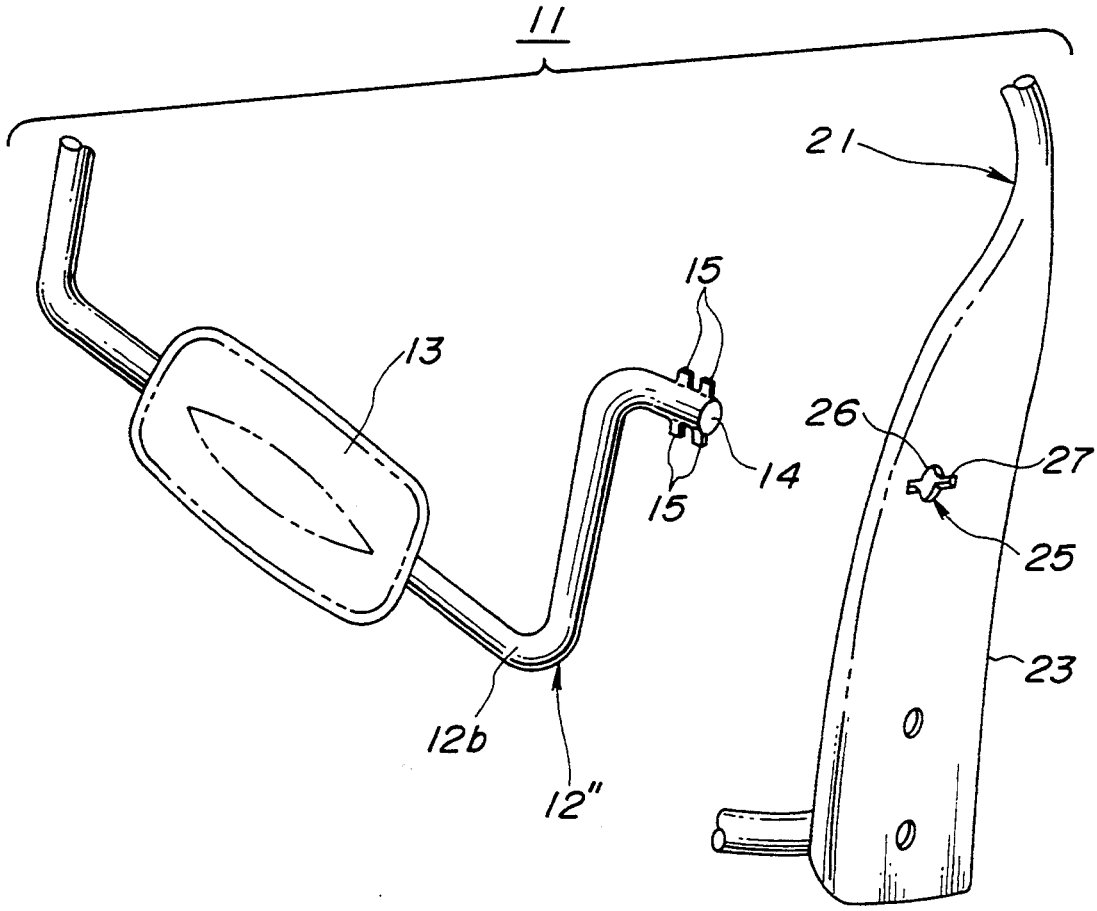
FIG. 6 is a view similar to FIG. 4 but showing a further embodiment of the present invention.

In the meantime, as shown in FIG. 6, the support shaft 12'' may have at each end 14 thereof two pairs of protrusions 15 which are axially spaced from each other a predetermined distance corresponding to the thickness of the side panel 23. By holding the side panel 23 between two pairs of protrusions 15, lateral or axial movement of the support shaft 12'' can be prevented more assuredly.

What is claimed is:

1. A support for a seat comprising:

a support shaft rotatably installed at its opposite ends on a seat back frame of said seat and having a cranked portion;

a support panel;

retainer means for rotatably holding said support panel on said support shaft; and means for limiting rotation of said support panel relative to said support shaft;

said support shaft having at said cranked portion an integral protrusion which protrudes radially outward in two opposed directions and is abuttingly engageable at opposite ends thereof with said support panel for preventing farther rotation of said support panel relative to said support shaft;

said support panel including a first vertically arcuate portion at which it is abuttingly engageable with said opposite ends of said protrusion of said support shaft;

said limiting means being constituted by said protrusion of said support shaft and said first arcuate portion of said support panel;

said retainer means including a retainer having an opening for allowing one of said opposite ends of said protrusion to protrude outward therethrough when the other of said opposite ends of said protrusion is abuttingly engaged with said first arcuate portion of said support panel.

2. A support according to claim 1, wherein said support panel has a pair of second vertically arcuate portions on opposite sides of said first vertically arcuate portion, and said retainer has a pair of vertically arcuate portions which cooperate with said second vertically arcuate portions of said support panel to rotatably hold therebetween said support shaft.

3. In a seat, a lumbar support assembly comprising:

a seat back frame having a pair of laterally opposed side panels;

a support shaft rotatably installed at its opposite ends on said side panels of said seat back frame and having a cranked portion; and a support panel limitedly rotatably installed on said cranked portion;

said side panels having openings in which said opposite ends of said support shaft are installed;

said support shaft having at each end a protrusion protruding radially outward of said support shaft;

each of said openings having a circular opening portion and a narrow, elongated opening portion protruding radially outward from a circumference of said circular opening portion, said narrow, elongated opening portion being sized so as to enable only said protrusion of said support shaft to pass therethrough;

each end of said support shaft provided with said protrusion being capable of passing through said opening only when said support shaft is held in a particular position where said cranked portion is located in a nearly horizontal plane;

said support shaft being normally held out of said particular position after each end thereof is passed through said opening to place said protrusion on an outer side of each side panel.

4. A lumbar support assembly as claimed in claim 3 wherein each end of said support shaft has two of said protrusions which are axially spaced a predetermined distance from each other so as to interpose each side panel therebetween.

5. A lumbar support assembly as claimed in claim 3, wherein said narrow, elongated opening portion is elongated substantially horizontally.

6. A lumbar support assembly as claimed in claim 5, wherein said protrusion and said cranked portion of said support shaft are located in a common plane.

7. A lumbar support assembly as claimed in claim 6, wherein said protrusion at each end of said support shaft consists of two sections protruding in opposite directions, and said narrow, elongated slit-like opening portion of said side panel consists of two sections protruding in opposite directions.

8. In a seat, a lumbar support assembly comprising:

a seat back frame having a pair of laterally opposed side panels;

a support shaft rotatably installed at its opposite ends on said side panels of said seat back frame and having a cranked portion movable forward and rearward of said seat back frame;

a support panel movable together with said cranked portion of said support shaft;

retainer means for rotatably holding said support panel on said support shaft; and means for limiting rotation of said support panel relative to said support shaft;

said support panel having a vertically arcuate portion;

said support shaft having at an outer end of said cranked portion an integral protrusion which protrudes radially outward in two opposed directions crossing the axis of said outer end of said cranked portion and which is abuttingly engageable at opposite ends thereof with said arcuate portion of said support panel for preventing further rotation of said support panel relative to said support shaft;

said protrusion of said support shaft and said arcuate portion of said support panel constituting said limiting means;

said side panels having openings in which said opposite ends of said support shaft are installed;

said support shaft having at each end a protrusion protruding radially outward from said support shaft;

each of said openings having a circular opening portion and a narrow, elongated opening portion protruding radially outward from a circumference of said circular opening portion, said narrow, elongated opening portion being sized so as to enable only said protrusion of said support shaft to pass therethrough;

each end of said support shaft with said protrusion being capable of passing through said opening only when said support shaft is held in a particular position where said cranked portion is located in a nearly horizontal plane;

said support shaft being normally held out of said particular position after each end thereof is passed through said opening to place said protrusion on an outer side of each side panel.

* * * * *